US007755297B2

(12) United States Patent
Lee et al.

(10) Patent No.: US 7,755,297 B2
(45) Date of Patent: Jul. 13, 2010

(54) DISPLAY APPARATUS AND CONTROL METHOD THEREOF

(75) Inventors: Sang-hoon Lee, Ulsan (KR); Jeong-Il Kang, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 243 days.

(21) Appl. No.: 11/797,434

(22) Filed: May 3, 2007

(65) Prior Publication Data

US 2008/0042590 A1 Feb. 21, 2008

(30) Foreign Application Priority Data

Jun. 28, 2006 (KR) ..... 10-2006-0058871

(51) Int. Cl.
*H05B 41/36* (2006.01)

(52) U.S. Cl. ..... 315/224; 315/225; 315/291

(58) Field of Classification Search ..... 315/291, 315/294, 297, 209 R, 86–93, 185 R, 186, 315/192, 193, 312, 313, 362
See application file for complete search history.

(56) References Cited

U.S. PATENT DOCUMENTS

| | | | | |
|---|---|---|---|---|
| 4,150,359 | A * | 4/1979 | Mizuno et al. | 340/475 |
| 4,433,272 | A * | 2/1984 | Ogawa | 315/290 |
| 2005/0116665 | A1* | 6/2005 | Colby et al. | 315/291 |
| 2005/0218835 | A1* | 10/2005 | Suzunaga et al. | 315/291 |
| 2005/0280375 | A1* | 12/2005 | Chikugawa et al. | 315/291 |
| 2006/0087262 | A1* | 4/2006 | Kim et al. | 315/312 |
| 2006/0202915 | A1* | 9/2006 | Chikugawa | 345/46 |
| 2008/0129219 | A1* | 6/2008 | Smith et al. | 315/291 |

FOREIGN PATENT DOCUMENTS

| | | |
|---|---|---|
| JP | 2002324685 | 11/2002 |
| JP | 2006049423 | 2/2006 |
| KR | 1020040107404 A1 | 12/2004 |

* cited by examiner

*Primary Examiner*—Douglas W Owens
*Assistant Examiner*—Jianzi Chen
(74) *Attorney, Agent, or Firm*—Roylance, Abrams, Berdo & Goodman, L.L.P.

(57) ABSTRACT

A display apparatus and a control method thereof are provided. The inventive method and apparatus improves a response speed of a light source and image quality by minimizing a ripple of a current and reducing a time required to increase/decrease an amount of a current to drive a light source when a light source is turned on and off or a size of a current used to drive a light source is changed. An exemplary display apparatus includes a light source, a current generator which generates a driving current to drive the light source, a first current consumer which has a smaller resistance value than the light source, a first switch which is switched on and off to supply the driving current generated by the current generator either to the light source or to the first current consumer and a controller which controls the current generator to generate the driving current to reach a target value, and controls the first switch to supply the driving current to the first current consumer if the target value is smaller than the driving current.

17 Claims, 8 Drawing Sheets

DISPLAY APPARATUS AND CONTROL METHOD THEREOF

CROSS-REFERENCE TO RELATED APPLICATIONS

This application claims the benefit under 35 U.S.C. §119 (a) of Korean Patent Application No. 2006-0058871, filed on Jun. 28, 2006, in the Korean Intellectual Property Office, the entire disclosure of which is hereby incorporated by reference.

BACKGROUND OF THE INVENTION

1. Field of the Invention

The present invention relates to a display apparatus and a control method thereof. More particularly, the present invention relates to a display apparatus, which improves image quality by reducing the time required to increase/decrease an amount of current supplied to a light source, and a control method thereof.

2. Description of the Related Art

A display apparatus such as a liquid crystal display (LCD) or a digital lighting processing (DLP) device employs a light emitting diode (LED) as a light source of a backlight unit. The LED is a point light source that provides high brightness and excellent color realization. Also, the LED is mercury-free and thus eco-friendly. The light emitting device such as the LED is driven by a current. Ideally, the light emitting device requires a driver having an output current with minimized ripples and with a quick response speed to improve image quality.

A conventional display apparatus having such an LED light source is classified as either a linear type or a switching type according to the control method of the LED light source. The switching type is not affected by load resistance, operates stably and is easily structured, compared to the linear type. Hereinafter, a control method of the LED light source using the conventional switching type will be described with reference to FIG. 1.

As shown therein, a current having a value of "ia" flows to the LED light source in a PWM on period (t1-t3, t5-) to turn on the LED light source. The current does not flow to the LED light source in a PWM off period (t3-t5) so that the LED light source is turned off. A switch is switched on and off in the PWM on period (t1-t3, t5-) according to a size of the necessary power for the LED light source, thereby increasing/decreasing the amount of the current supplied to the LED light source and allowing a current having the average value of "ia" flowing therein over the time t2-t3.

When the conventional switching type display apparatus is used, it takes times T1 and T3 for the current flowing in the LED light source to reach the average current value "ia" from the time t1 and t5 of the PWM on period, respectively, thereby causing a slow response speed. When reaching the time t3, which begins the PWM off period, it takes time T2 to consume an energy charged in an inductor and a capacitor through the LED light source, also causing a slow response speed.

The conventional display apparatus having the switching type control for the LED light source also has a limitation regarding a ripple supplied to the LED. Furthermore, the conventional display apparatus is limited with regard to a response speed to maintain image quality when the LED light source is turned on/off or a current used to drive the LED light source is changed.

Accordingly, there is a need for an improved display apparatus and control method thereof having an improved response speed and quality.

SUMMARY OF THE INVENTION

Exemplary embodiments of the present invention address at least the above problems and/or disadvantages and provide at least the advantages described below. Accordingly, it is an aspect of the present invention to provide a display apparatus and a control method thereof which improves a response speed of a light source and an image quality by minimizing a ripple of a driving current and reducing a time required to increase/decrease an amount of the driving current used to drive a light source when the light source is turned on and off or a size of the driving current used to drive the light source is changed.

Additional exemplary aspects and/or advantages of the present invention will be set forth in part in the description which follows and, in part, will be obvious from the description, or may be learned by practice of the present invention.

The foregoing and/or other exemplary aspects of the present invention may be achieved by providing a display apparatus comprising a light source, a current generator for generating a driving current to drive the light source, a first current consumer which has a smaller resistance value than the light source, a first switch for switching on and off to supply the driving current generated by the current generator either to the light source or to the first current consumer, and a controller for controlling the current generator to generate the driving current to reach a target value and for controlling the first switch to supply the driving current to the first current consumer if the driving current is larger than the target value.

According to an exemplary embodiment of the present invention, the display apparatus may further comprise a second current consumer which has a smaller resistance value than the first current consumer and a second switch for supplying the driving current generated by the current generator to the second current consumer, wherein the controller controls the second switch to supply the driving current to the second current consumer if the target value is larger than the driving current.

The foregoing and/or other exemplary aspects of the present invention may be achieved by providing a display apparatus comprising a light source, a current generator for generating a driving current to drive the light source, a first current consumer which has a smaller resistance value than the light source, a first switch for switching on and off to supply the driving current generated by the current generator either to the light source or to the first current consumer, and a controller for controlling the current generator to generate the driving current to reach a target value and for controlling the first switch to supply the driving current to the first current consumer if the target value is larger than the driving current.

According to an exemplary embodiment of the present invention, the first current consumer and the first switch are connected with each other in series, and the first current consumer and the first switch are connected with the light source in parallel.

According to an exemplary embodiment of the present invention, the second current consumer and the second switch are connected with each other in series, and the second current consumer and the second switch are connected with the light source in parallel.

According to an exemplary embodiment of the present invention, the light source comprises a light emitting diode (LED).

According to an exemplary embodiment of the present invention, the first switch comprises a transistor which is turned on and off by the controller.

According to an exemplary embodiment of the present invention, the second switch comprises a transistor which is turned on and off by the controller.

According to an exemplary embodiment of the present invention, the controller disables the current generator when the display apparatus is turned off.

The foregoing and/or other exemplary aspects of the present invention may be achieved by providing a method of controlling a display apparatus which includes a light source and a first current consumer having a smaller resistance value than the light source, the method comprising generating a driving current to drive the light source, determining whether the generated driving current reaches a target value and consuming the driving current by the first current consumer if the driving current is larger than the target value.

According to an exemplary embodiment of the present invention, the consuming of the driving current may comprise consuming the driving current by a resistance value smaller than the first current consumer if the target value is larger than the driving current.

BRIEF DESCRIPTION OF THE DRAWINGS

The above and/or other exemplary aspects and advantages of the present invention will become apparent and more readily appreciated from the following description of exemplary embodiments, taken in conjunction with the accompanying drawings of which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention and are merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness. Reference will now be made in detail to exemplary embodiments of the present invention which are illustrated in the accompanying drawings.

Figure 1A:
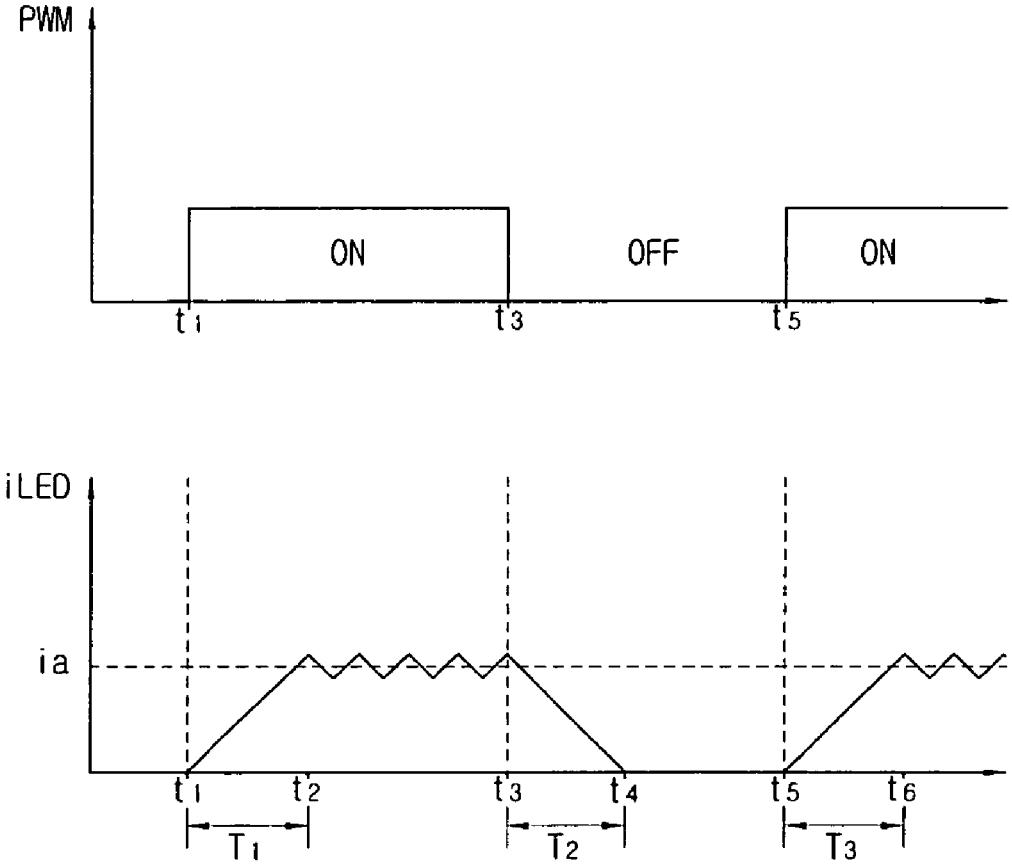
FIG. 1A (Related Art)
FIGS. 1A and 1B illustrate an LED driving current waveform which applies to a conventional driving control method.
Figure 1B:
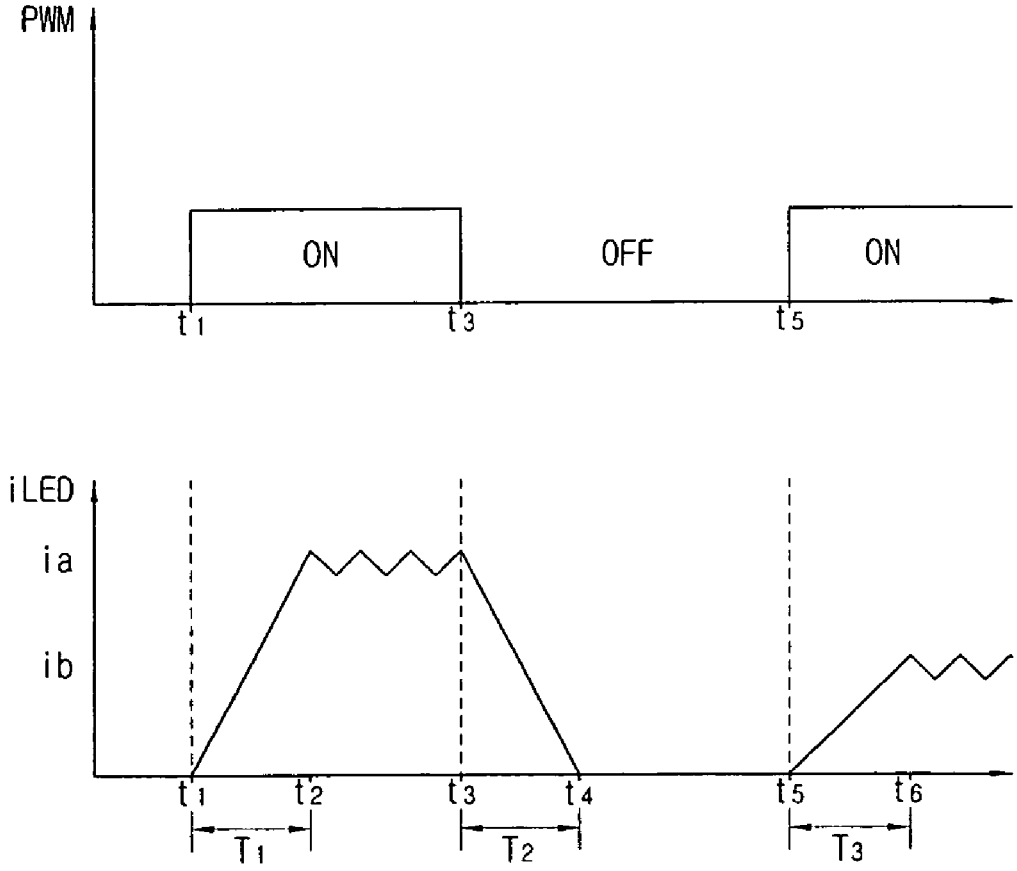
FIG. 1B (Related Art)
Figure 2A:
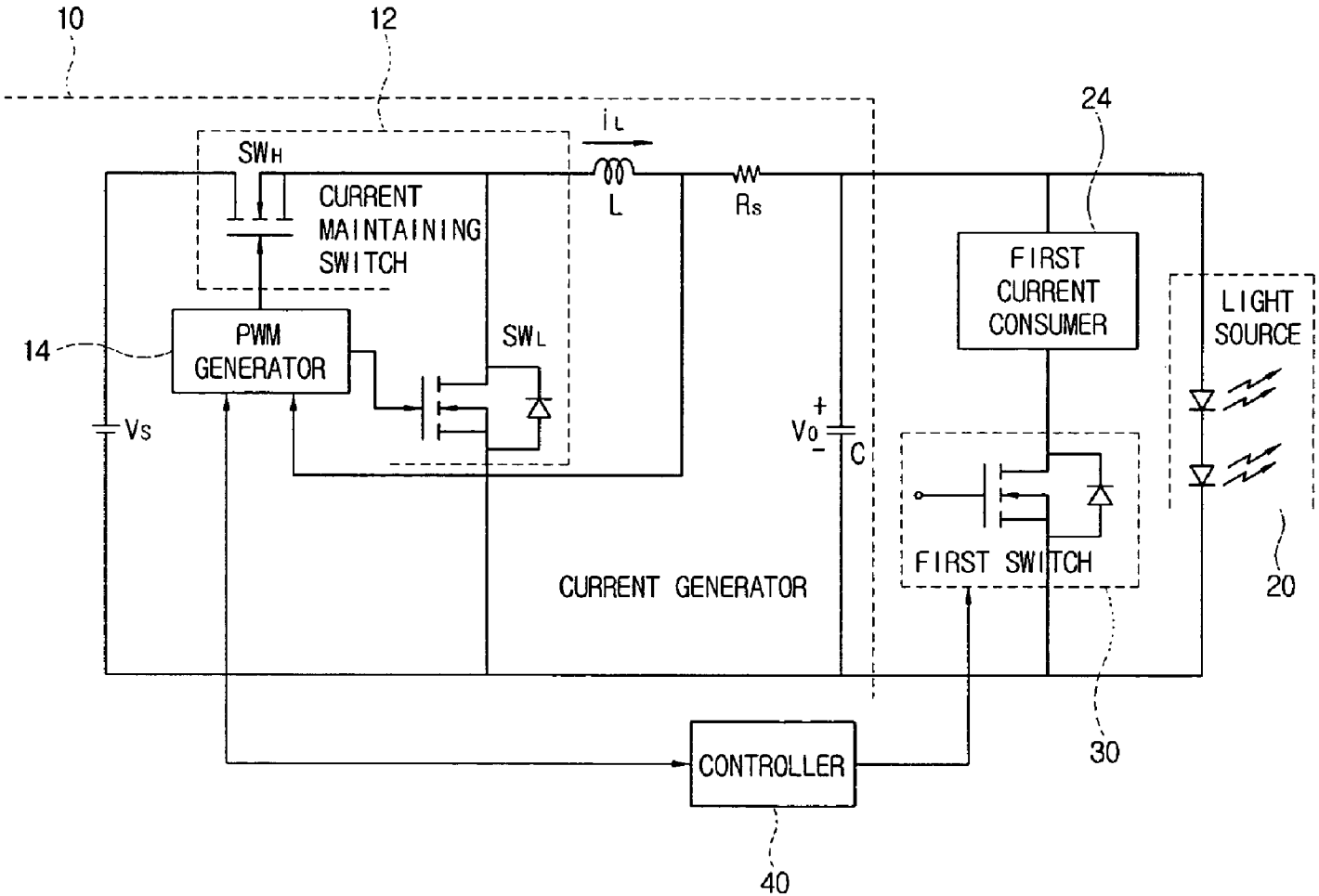
FIGS. 2A and 2B illustrate a control block diagram and an LED driving current waveform of a display apparatus according to an exemplary embodiment of the present invention.

FIG. 2A is a control block diagram of an LED driving circuit of a display apparatus according to an exemplary embodiment of the present invention. As shown therein, the display apparatus according to an exemplary embodiment of the present invention comprises a light source 20, a current generator 10 for generating a driving current to drive the light source 20, a first current consumer 24 which has a smaller resistance value than the light source 20, a first switch 30 for switching on/off to supply the driving current from the current generator 10 either to the light source 20 or to the first current consumer 24, and a controller 40 for controlling the current generator 10 to make the driving current reach a target value and for controlling the first switch 30 to supply the driving current to the first current consumer 24 if the driving current exceeds the target value.

The light source 20 supplies light to a display part (not shown) which displays an image. In an exemplary embodiment, the light source 20 may comprise a light emitting diode (LED). The light source 20 may further comprise a plurality of LED elements or other light source as applicable or desired.

The current generator 10 supplies a driving current to the light source 20. The current generator 10 comprises a pulse width modulator (PWM) generator 14 for controlling a flow of current to be maintained according to an order value corresponding to a desired brightness of the light source 20, a current maintaining switch 12 for controlling a current flow from a power source Vs to the light source 20, an inductor L and a current detecting resistor Rs which are provided between a branching point of the first current consumer 24 and the light source 20 and the current maintaining switch 12, and are in series, and a capacitor C which is provided between the branching point of the first current consumer 24 and the light source 20 and the current detecting resistor Rs.

The current maintaining switch 12 controls the current flow from the power source Vs to the light source 20. The current maintaining switch 12 may comprise a first maintaining switch $SW_H$ and a second maintaining switch $SW_L$. The first maintaining switch $SW_H$ and the second maintaining switch $SW_L$ may be alternately turned on/off by a PWM control of the PWM generator 14 to supply current to the light source 20. In an exemplary embodiment, the current maintaining switch 12 may comprise a metal oxide silicon field effect transistor (MOSFET). Other switches, for example a bipolar device or thyristor, may also be used.

The PWM generator 14 PWM-controls the current maintaining switch 12 so that the current generator 10 outputs a driving current to be maintained according to the order value corresponding to the desired brightness of the light source 20. The PWM generator 14 may receive a turn-on control signal (order value) for the light source 20 from the controller 40 at an initial driving stage of the display apparatus, and turn on the current maintaining switch 12 according thereto.

The PWM generator 14 detects a comparison voltage from the current detecting resistor Rs, and determines whether the current flowing either to the first current consumer 24 or to the light source 20 is higher than a desired current value by comparing the detected comparison voltage and the order value. When the detected comparison voltage is higher than the order value, the PWM generator 14 turns off the current maintaining switch 12. That is, the PWM generator 14 turns off the first maintaining switch $SW_H$ and turns on the second maintaining switch $SW_L$ of the current maintaining switch 12. When a time period elapses after turning off the current maintaining switch 12, the PWM generator 14 turns on the current maintaining switch 12.

The PWM generator 14 turns on the current maintaining switch 12 according to the control of the controller 40, and repeatedly turns on and off the current maintaining switch 12 based on the comparison result of the comparison voltage applied on the current detecting resistor Rs and the order value, and the time period. Thus, the current generator 10 maintains and outputs a current regardless of the on/off operation of the light source 20 while the display apparatus operates. In an exemplary embodiment, the output current is a constant current.

When the display apparatus is in an off state, the PWM generator 14 is disabled by the controller 40. In such an off state, the current generator 10 may not output the driving current.

The first switch 30 supplies the driving current output from the current generator 10 either to the first current consumer 24 or to the light source 20. The first switch 30 may be turned on and off by the PWM control signal of the controller 40 and supplies the driving current, supplied from the current generator 10 to the light source 20, or to the first current consumer 24. In an exemplary embodiment, the first switch 30 comprises a MOSFET. The first switch 30 may also comprise a bipolar junction transistor, a thyristor, or other switching device.

The first current consumer 24 may consume the driving current generated by the current generator 10. The first current consumer 24 may comprise a dummy load and may have a smaller resistance value than the light source 20. When the light source 20 is on an off state, the first switch 30 is turned on so as to supply the driving current to the first current consumer 24, thereby reducing the time necessary to decrease the current and providing an improved response speed of the light source 20.

The controller 40 outputs the PWM control signal and controls the first switch 30 to supply the driving current output from the current generator 10 to the light source 20 when the light source 20 is turned on, and to supply the driving current to the first current consumer 24 when the light source 20 is turned off. When the first switch 30 is turned on, the current flowing in the inductor L and the voltage charged in the capacitor C are rapidly consumed by the first current consumer 24, thereby providing a fast response speed while the light source 20 is turned off.

Hereinafter, the turn-on/off operation of the light source 20 will be described as an example. When an image to be displayed does not require blue (B) color, LED light sources corresponding to red (R) and green (G) colors are turned on to receive the driving current while the LED light source corresponding to the blue (B) color is turned off so as not to receive the driving current. The turned on and turned off operation of light source 20 may be only temporary.

Exemplary embodiments of the present invention are applicable to a display apparatus using a light source 20 such as a liquid crystal display (LCD) or a digital lighting processing (DLP) device to display an image. In an exemplary embodiment, the display apparatus displays an image with a DLP device.

Figure 2B:
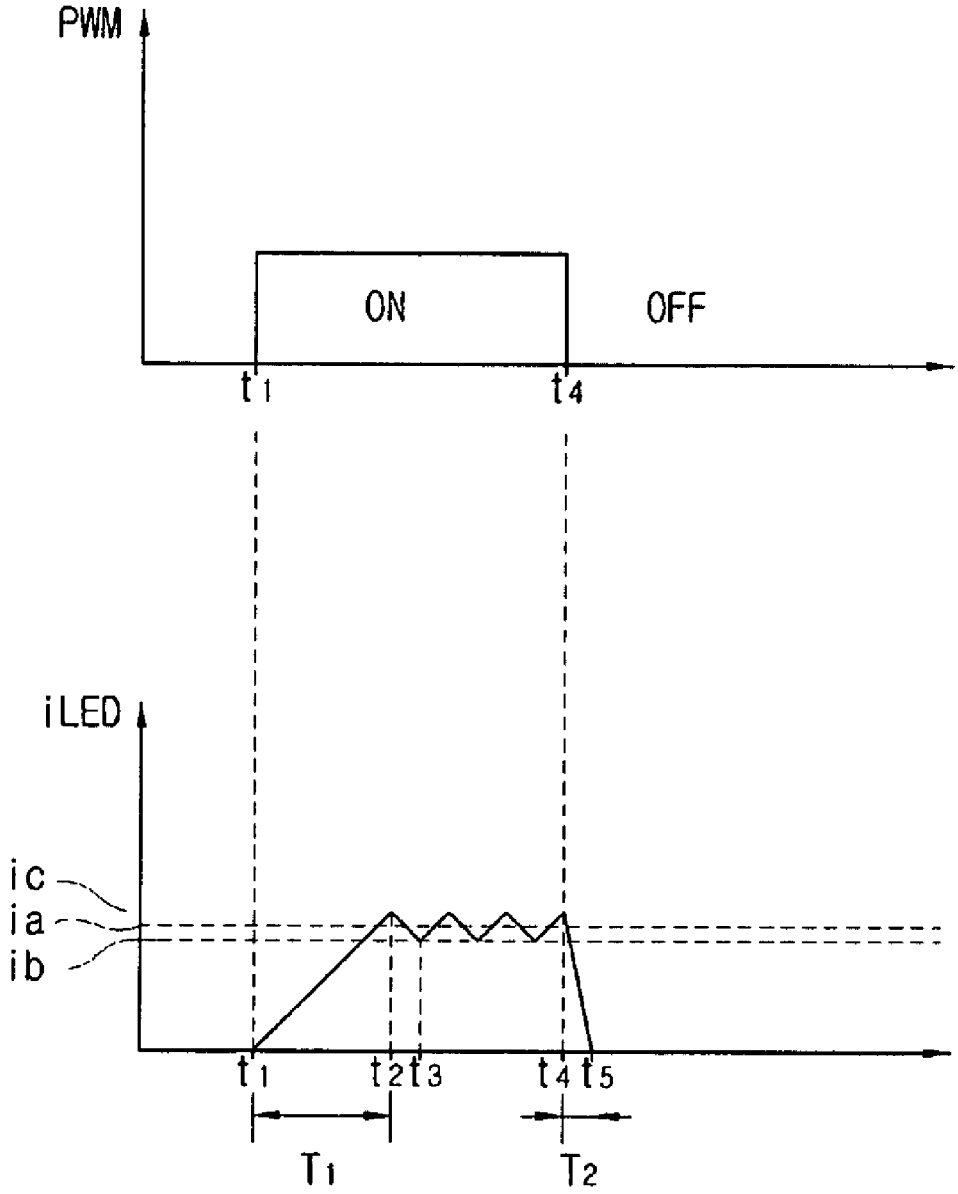

Hereinafter, a method of controlling the light source 20 of the display apparatus according to an exemplary embodiment of the present invention will be described with reference to FIGS. 2A and 2B. FIG. 2B illustrates a PWM control signal controlling the first switch 30 and a driving current waveform of the light source 20.

When the display apparatus is initialized by an input of a power key (not shown) thereof (time t1), the controller 40 controls the current generator 10 to output the driving current corresponding to the order value. The driving current is output by inputting a turn-on control signal (order value) from the controller 40 to the PWM generator 14, and by turning on the first maintaining switch $SW_H$ of the current maintaining switch 12. At this time, the controller 40 outputs the PWM control signal to turn off the first switch 30. The driving current output from the power source Vs is charged in the inductor L and the capacitor C and supplied to the light source 20 through the current detecting resistor Rs. The flow path of the driving current is Vs→L→Rs→light source 20→Vs. Referring to FIG. 2B, at the initial time (t1-t2) of supplying the driving current to the light source 20, the light source 20 is turned on and the size of the current flowing in the inductor L and the light source 20 becomes larger. The response time T1 of the light source at the initialization of the display apparatus is similar to that of the conventional art.

The PWM generator 14 detects the comparison voltage at the current detecting resistor Rs and calculates a comparison current based on the detected comparison voltage. The PWM generator 14 compares the calculated comparison current value and the order value. When the calculated comparison current is higher than the order value (time t2), the PWM generator 14 determines that the size of the driving current of the light source 20 is higher than the current value "ic", and turns off the first maintaining switch $SW_H$ of the current maintaining switch 12. Thus, the current charged in the inductor L is supplied to the light source 20 and the second maintaining switch $SW_L$ of the current maintaining switch 12 through the current detecting resistor Rs. The flow path of the current is L→Rs→light source 20→$Sw_L$→L. The current flowing in the inductor L and the light source 20 becomes smaller from the time t2 on.

When a time period elapses (t2-t3) after turning off the first maintaining switch $SW_H$ of the current maintaining switch 12, the PWM generator 14 turns on the first maintaining switch $SW_H$ of the current maintaining switch 12. From the time t3 on, the flow path of the driving current again becomes Vs→L→Rs→light source 20→Vs. Thus, the current flowing in the inductor L and the light source 20 becomes larger again.

The PWM generator 14 calculates the comparison current based on the comparison voltage at the current detecting resistor Rs. Based on the comparison result of the calculated comparison current value and the order value, and the time period, the PWM generator 14 repeatedly turns on and off the current maintaining switch 12. Accordingly, the current flowing in the inductor L and the light source 20 maintains the value of "ia" which is an average of values "ic" and "ib"

When the light source 20 is to be turned off (time t4), the controller 40 outputs the PWM control signal to turn on the first switch 30 as shown in FIG. 2B. That is, the current supplied to the light source 20 is cut off at the time t4 and when the current flowing in the light source 20 reaches the current value "ic" at the time t4, the PWM generator 14 turns off the first maintaining switch $SW_H$ of the current maintaining switch 12. From the time t4 on, the first switch 30 is turned on and the current charged in the inductor L is supplied to the second maintaining switch $SW_L$ of the current maintaining switch 12 through the current detecting resistor Rs and the first current consumer 24. The flow path of the current is L→Rs→first current consumer 24→$SW_L$→L. Accordingly, when the light source 20 is turned off, the off response speed of the light source 20 is improved as shown by the duration of T2 as compared with that of the conventional art. As the first current consumer 24 has a smaller resistance value than the light source 20, the current flowing in the inductor L is consumed by the current consumer 24 faster than that consumed if first switch 30 were not turned on. Therefore, during the turn-off of the light source 20, the time necessary for the current to decrease is reduced, thereby providing a display apparatus having an improved image quality.

Hereinafter, a display apparatus according to an exemplary embodiment of the present invention will be described with reference to FIGS. 3A and 3B.

Figure 3A:
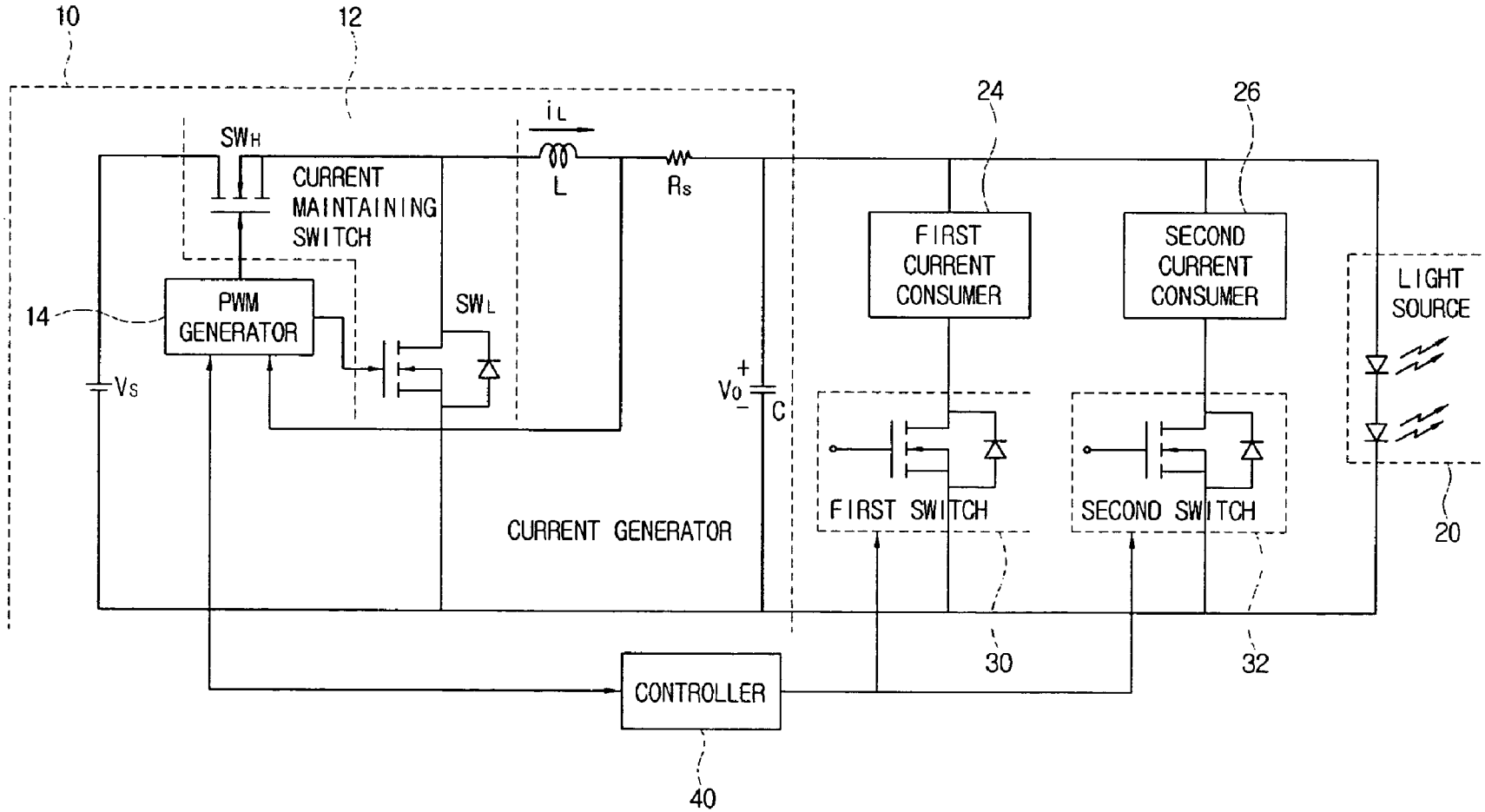
FIG. 3A is a control block diagram of a display apparatus according to an exemplary embodiment of the present invention.
Figure 3B:
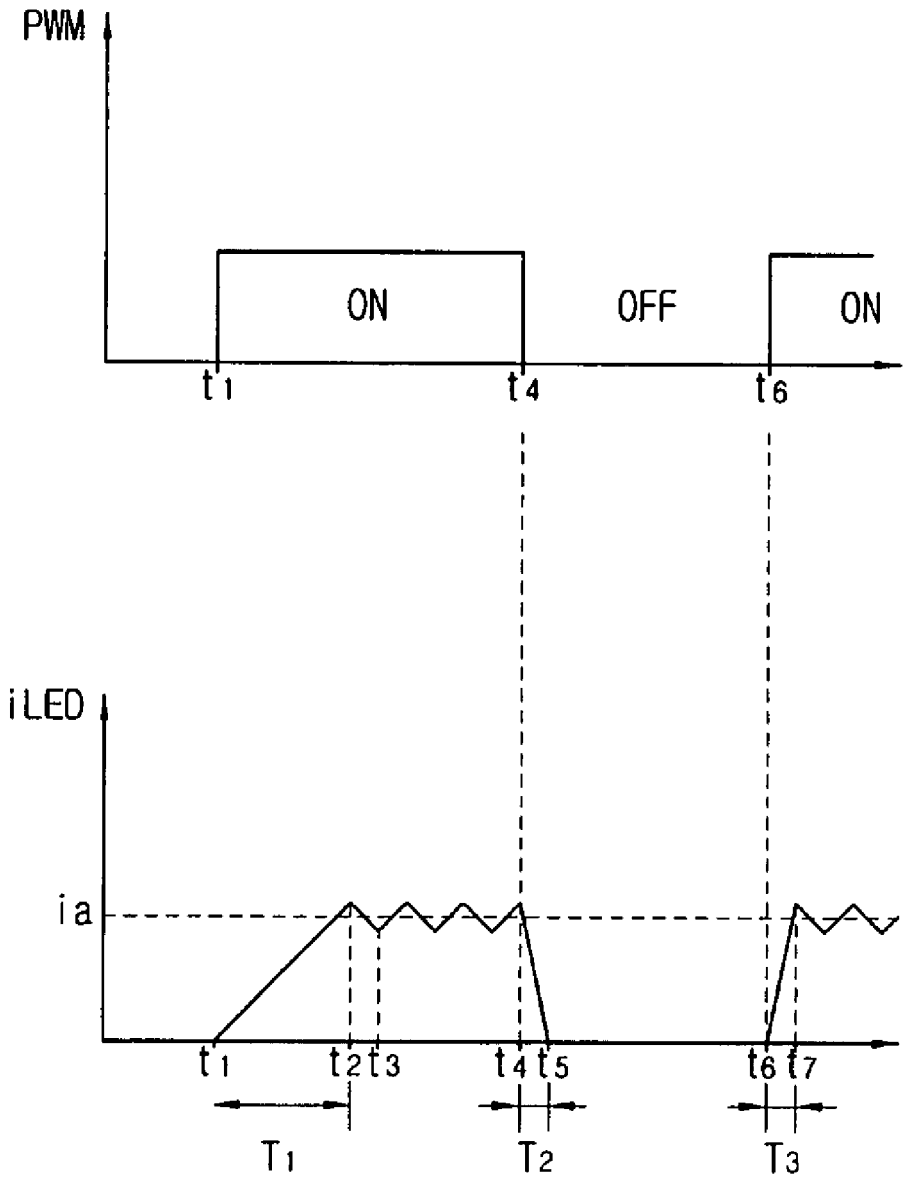
FIGS. 3B and 3C illustrate an LED driving current waveform according to an exemplary embodiment of the present invention.

FIG. 3A is a control block diagram of an LED driving circuit of a display apparatus according to an exemplary embodiment of the present invention. A display apparatus according to an exemplary embodiment of the present invention comprises a second current consumer 26 and a second switch 32 which is connected with the second current consumer 26 in series. Other elements of the exemplary display apparatus may be similar to those shown in FIG. 2A as evidenced by the repeated reference numerals.

Similar to first current consumer 24, second current consumer 26 may consume a driving current generated by a current generator 10. However, the second current consumer 26 has a smaller resistance value than the first current consumer 24. When the previous driving current flowing during the turn-on of the light source 20 is smaller than a next turn on driving current with a temporary turn off there between, the second current consumer 26 receives the driving current generated by the current generator 10 until a next turn-on of the light source 20, to provide a fast response speed when the light source 20 is turned on. When the previous driving current flowing during the previous turn-on of the light source 20 is larger than the next driving current, the first current consumer 24 consumes the excess current and the second current consumer 26 receives the remainder thereof, thereby providing a fast response speed when the light source 20 is turned on again. The driving current flowing in the second current consumer 26 is supplied to the light source 20 when the light source 20 is turned on. Thus, the second current consumer 26 comprises a resistor having a smaller resistance value than that of the light source 20. In an exemplary embodiment, the resistor of the second current consumer 26 comprises only a conductive wire.

The second switch 32 supplies the driving current output from the current generator 10 either to the second current consumer 26 or to the light source 20. The second switch 32, similar to the first switch 30, is switched on and off by a PWM control signal of a controller 40 and supplies the driving current from the current generator 10 to the second current consumer 26. In an exemplary embodiment, the second switch 32 comprises a metal oxide silicon field effect transistor (MOSFET). The second switch 32 may also comprise a bipolar junction transistor, a thyristor, or other switching device.

The controller 40 outputs the PWM control signal for controlling the second switch 32 to supply the driving current to the second current consumer 26 when the light source 20 is turned off. When the second switch 32 is turned on, the current flowing in the inductor L and the voltage charged in the capacitor C are consumed by the second current consumer 26, thereby providing a fast response speed when the light source 20 is turned on.

Hereinafter, a method of controlling the light source 20 of the display apparatus according to an exemplary embodiment of the present invention will be described with reference to FIG. 3B. FIG. 3B illustrates the PWM control signal controlling the first and second switches 30 and 32 and a driving current waveform of the light source 20. The light source 20 is again driven with a driving current value "ia," turned off, and then driven again with the value "ia".

A display apparatus according to an exemplary embodiment of the present invention is initialized by an input of a power key (not shown) thereof. The light source 20 of a display apparatus according to an exemplary embodiment of the present invention is turned off at time t4 after the current supplied to the light source has risen to the value "ia".

The PWM generator 14 controls the second switch 32 to turn on when the light source 20 is turned off. The driving current output from a power source Vs is charged in the inductor L through a current maintaining switch 12 to be supplied to the second current consumer 26 through a current detecting resistor Rs by the second switch 32 (Vs→L→Rs→second current consumer 26→Vs). Thus, the current flowing in the inductor L becomes larger regardless of the turn-on/off operation of the light source 20.

The PWM generator 14 repeatedly turns on and off the current maintaining switch 12 based on a comparison result of a comparison voltage at the current detecting resistor Rs and an order value, and a time period. The current flowing in the inductor L has the value of "ia" which is an average of a current "ic" and a current "ib", regardless of the turn-on/off operation of the light source 20.

When the light source 20 is turned on again (time t6), the controller 40 outputs the PWM control signal to turn off the second switch 32. The time t6 refers to the time when a time period elapses after the current maintaining switch 12 is turned off. Here, the PWM generator 14 turns on a first maintaining switch $SW_H$ of the current maintaining switch 12. Then, the flow path of the current is changed from Vs→L→Rs→second current consumer 26→Vs (before the time t6), to Vs→L→Rs→light source 20→Vs (since the time t6). At the time t6, the current directly flows from the inductor L to the light source 20, thereby shortening a response time T3 of the light source 20 during the turn-on of the light source 20. The current flowing in the inductor L becomes larger regardless of the turn-on/off operation of the light source 20.

The current flowing in the inductor L and the light source 20 rapidly reaches and maintains the value of "ia" by the turn-on/off of the current maintaining switch 12 in the PWM generator 14 when the light source 20 is turned on.

As described above, a display apparatus according to an exemplary embodiment of the present invention improves the off response speed of the light source 20 by changing the flow path of the driving current to L→Rs→first current consumer 24→$SW_L$→L during the turn-off of the light source 20. Also, a display apparatus according to an exemplary embodiment of the present invention improves the on response speed of the light source 20 by changing the flow path of the driving current from Vs→L→Rs→second current consumer 26→Vs during the turn-off of the light source 20, to Vs→L→Rs→light source 20→Vs during the turn-on of the light source 20, thus enabling the current flowing in the light source 20 to more quickly rise to the value of "ia".

Figure 3C:
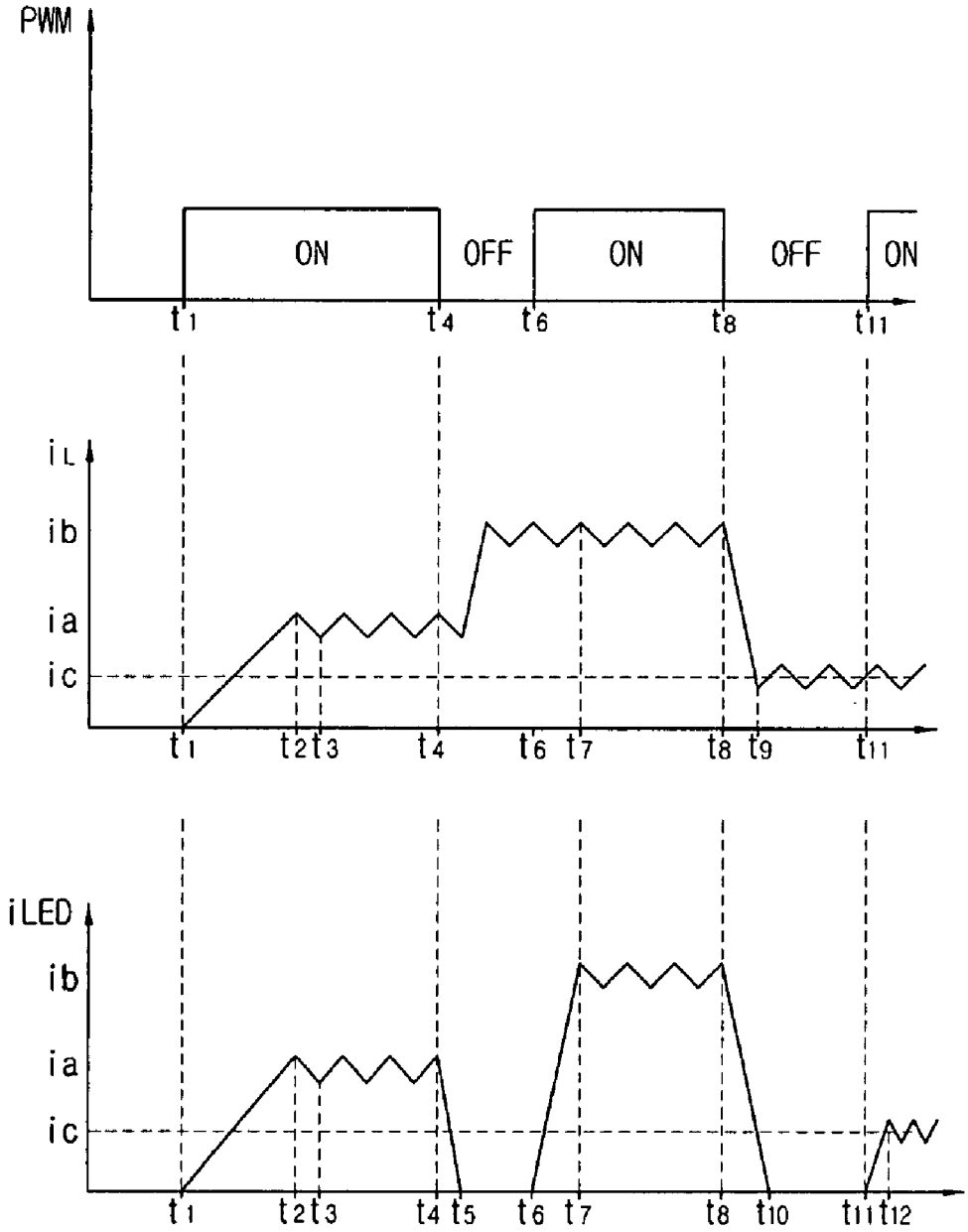

FIG. 3C illustrates an example of various driving current values supplied to the light source 20 after the display apparatus is initialized by the input of a power key. As shown therein, the display apparatus is first driven by the input of a power key and the driving current flowing in the light source 20 rises to the value "ia" as previously described. The operation of the light source 20 until the time t4 is also similar to that previously described. When the current value is "ib" which is larger than the value "ia", the PWM generator 14 changes the flow path of the driving current from Vs→L→Rs→light source 20→Vs or L→Rs→light source 20→$SW_L$→L, to Vs→L→Rs→second current consumer 26→Vs when the light source 20 is to be turned on again after being turned off, thereby improving the on response speed of the light source 20.

The PWM generator 14 turns on the first maintaining switch $SW_H$ of the current maintaining switch 12 and the second switch 32 so that the flow path of the driving current becomes Vs→L→Rs→second current consumer 26→Vs, thereby raising the driving current to a value of "ib". The PWM generator 14 makes the driving current maintain the value "ib" before a next turn-on of the light source 20. When the light source 20 is turned on, the current having the value "ib" flows directly to the light source 20, thereby improving the on response speed of the light source 20

The operation of the light source 20 driven by the driving current value "ib" to be turned off at the time t8 is similar to that driven by the driving current value "ia". In an exemplary embodiment however, the light source 20 is turned on again by a driving current value "ic" which is smaller than the value "ib" as shown in FIG. 3C.

To obtain a driving current value of "ic" after the light source 20 is turned off, the PWM generator 14 turns off the first switch $SW_H$ of the current maintaining switch 12 and turns on the first switch 30 so that the driving current flows to L→Rs→first current consumer 24→L and reaches the value of "ic", thereby quickly consuming the driving current. The driving current maintains the value of "ic" before the next turn-on of the light source 20. When the light source 20 is turned on, the driving current having the value of "ic" flows thereto directly, thereby improving the on/off response speed of the light source 20.

Figure 4:
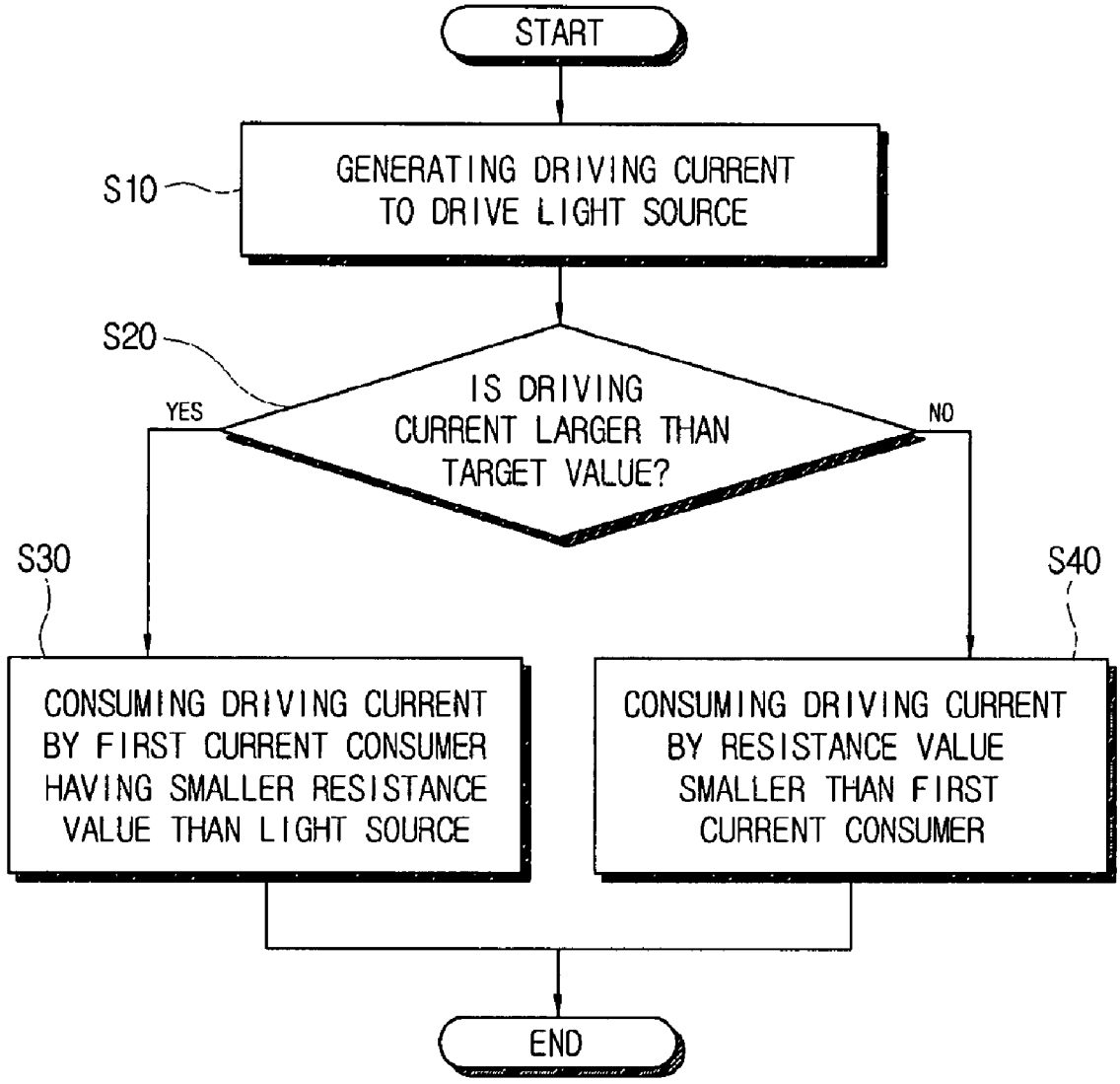
FIG. 4 is a control flowchart of the display apparatus according to an exemplary embodiment of the present invention.

Hereinafter, a method of controlling the display apparatus according to an exemplary embodiment of the present invention will be described with reference to FIG. 4. First, the controller 40 controls the current generator 10 to generate the driving current and to drive the light source 20 (S10). The controller 40 determines whether the driving current reaches the target value (S20). When the driving current generated at the step of S10 is larger than the target value, the driving current is consumed by the first current consumer 24 having a smaller resistance value than the light source 20 (S30). Then, the driving current generated at the step of S10 is consumed faster than that consumed by the light source 20. The ramp-down time of the current during the turn-off of the light source 20 is reduced, thereby providing a method of controlling the display apparatus having an improved image quality.

As described above, the controller 40 determines whether the driving current generated at the step of S10 reaches the target value (S20), and performs the step of S30 when the target value is smaller than the driving current. When the driving current generated at the step of S10 is smaller than the target value, the controller 40 controls the driving current to be consumed by the resistance value smaller than the first current consumer 24 (S40). Thus, exemplary embodiments of the present invention provide a control method of a display apparatus which improves on/off response speed of the light source 20 and provides an improved image quality.

As described above, exemplary embodiments of the present invention provide a display apparatus which improves a response speed of a light source and provides an improved image quality by reducing the time required to increase/decease a current driving a light source when a light source is turned on and off or a current driving a light source is changed.

Although a few exemplary embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A display apparatus, comprising:

a light source;

a current generator for generating a driving current to drive the light source;

a first current consumer which has a smaller resistance value than the light source;

a first switch which is switched on and off to supply the driving current generated by the current generator either to the light source or to the first current consumer; and a controller for controlling the current generator to generate the driving current to reach a target value, and for controlling the first switch to supply the driving current to the first current consumer if the driving current is larger than the target value.

2. The display apparatus according to claim 1, wherein the first current consumer and the first switch are connected with each other in series, and the first current consumer and the first switch are connected with the light source in parallel.

3. The display apparatus according to claim 1, wherein the light source comprises a light emitting diode (LED).

4. The display apparatus according to claim 1, wherein the first switch comprises a transistor which is turned on and off by a control of the controller.

5. The display apparatus according to claim 1, wherein the controller controls the current generator to be disabled when the display apparatus is turned off.

6. The display apparatus according to claim 1, further comprising:

a second current consumer which has a smaller resistance value than the first current consumer; and a second switch for supplying the driving current generated by the current generator to the second current consumer, wherein the controller controls the second switch to supply the driving current to the second current consumer if the target value is larger than the driving current.

7. The display apparatus according to claim 6, wherein the first current consumer and the first switch are connected with each other in series, and the first current consumer and the first switch are connected with the light source in parallel.

8. The display apparatus according to claim 6, wherein the second current consumer and the second switch are connected with each other in series, and the second current consumer and the second switch are connected with the light source in parallel.

9. The display apparatus according to claim 6, wherein the second switch comprises a transistor which is turned on and off by a control of the controller.

10. A method of controlling a display apparatus which includes a light source and a first current consumer having a smaller resistance value than the light source, the method comprising:

generating a driving current to drive the light source;

determining whether the generated driving current reaches a target value;

supplying the driving current either to the light source or to the first current consumer depending on the determination; and consuming the driving current by the first current consumer if the driving current is larger than the target value.

11. The method according to claim 10, wherein the consuming of the driving current comprises consuming the driving current by a resistance value smaller than the first current consumer if the target value is larger than the driving current.

12. An apparatus connected to an electrical load comprising:

a first current consumer having a smaller resistance value than the electrical load;

a first switch, which is switched on and off to supply current either to the electrical load or the first current consumer; and a controller for controlling the first switch to supply the current to the first current consumer if the current is larger than a target value.

13. The display apparatus according to claim 12, wherein the first current consumer and the first switch are connected with each other in series, and the first current consumer and the first switch are connected with the electrical load in parallel.

14. The display apparatus according to claim 12, wherein the first switch comprises a transistor which is turned on and off by a control of the controller and further wherein the load comprises a light source and the light source comprises a light emitting diode (LED).

15. The display apparatus according to claim 12, further comprising:

a second current consumer which has a smaller resistance value than the first current consumer; and a second switch for supplying the current to the second current consumer, wherein the controller controls the second switch to supply the current to the second current consumer if the driving current is smaller than the target value.

16. The display apparatus according to claim 15, wherein the first current consumer and the first switch are connected with each other in series, and the first current consumer and the first switch are connected with the light source in parallel.

17. The display apparatus according to claim 16, wherein the second current consumer and the second switch are connected with each other in series, and the second current consumer and the second switch are connected with the light source in parallel.

* * * * *